United States Patent [19]

Fiske

[11] Patent Number: 4,993,717

[45] Date of Patent: Feb. 19, 1991

[54] YOUNG GIRLS BOARD GAME

[76] Inventor: Holly Fiske, 12 E. Garfield St., Apt. 2-B, Bay Shore, N.Y. 11706

[21] Appl. No.: 533,754

[22] Filed: Jun. 6, 1990

[51] Int. Cl.[5] ..... A63B 3/00

[52] U.S. Cl. ..... 273/243; 273/285; 273/1 G; 273/1 R; 273/DIG. 17; 273/288

[58] Field of Search ..... 273/276, 256, 243, 248, 273/249, 1 GG, 1 GF, 1 G, DIG. 17–19, 285, 1 R, 288

[56] References Cited

U.S. PATENT DOCUMENTS

| | | | |
|---|---|---|---|
| 3,371,931 | 5/1968 | Saunders | 273/249 |
| 3,994,499 | 11/1976 | Barlow | 273/256 |
| 4,666,162 | 5/1987 | Campbell | 273/256 |

FOREIGN PATENT DOCUMENTS

| | | | |
|---|---|---|---|
| 611043 | 5/1945 | United Kingdom | 273/276 |

OTHER PUBLICATIONS

Strip Checkers, Breck Catalog; received 5/1/71.

*Primary Examiner*—Benjamin Layno
*Attorney, Agent, or Firm*—Michael I. Kroll

[57] ABSTRACT

A young girl's board game is provided and consists of playing pieces, make-up kits, a game board and a die. Each playing piece represents one young girl player which each kit is used by one young girl player. The game board has a continuous path around its perimeter divided into consecutive spaces, in which one space is a start for the playing pieces, while the other spaces bear instructions in which most of the instructions indicate what items each young girl player must put on and take off from their make-up kit when their playing piece lands thereon during the play of the game. The die produces random numeric designations representing travel movements for each playing piece along the continuous path of the spaces, so that when each playing piece lands on one space the instructions will be followed, until the first young girl player to put on all of the items from her make-up kit will become the winner.

7 Claims, 1 Drawing Sheet

YOUNG GIRLS BOARD GAME

FIELD OF THE INVENTION

The instant invention relates generally to board games and more specifically it relates to a young girls board game.

DESCRIPTION OF THE PRIOR ART

Numerous board games have been provided in prior art that are adapted to entertain the players by challenging them so that they utilize their skills and acumen in playing the games while at the same time provide an element of chance to add a bit of adventure and luck to the games. While these units may be suitable for the particular purpose to which they address, they would not be as suitable for the purposes of the present invention as heretofore described.

SUMMARY OF THE INVENTION

A primary object of the present invention is to provide a young girls board game that will overcome the shortcomings of the prior art devices.

Another object is to provide a young girls board game that is designed for girls ages six and up where they will love to put on and take off jewelry, fake fingernails and light make-up during the play of the game.

An additional object is to provide a young girls board game that is extremely fun to play and will keep the girls busy and amused for a long period of time.

A further object is to provide a young girls board game that is simple and easy to use.

A still further object is to provide a young girls board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
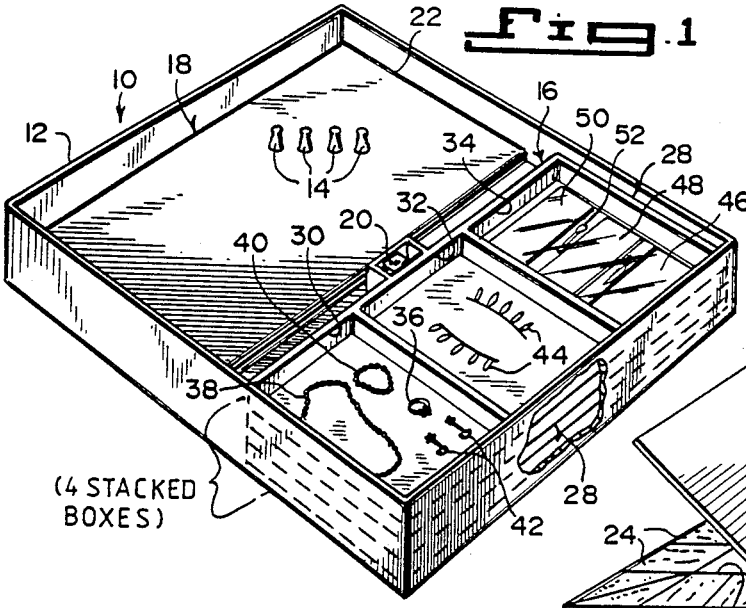
FIG. 1 is a perspective view with parts broken away showing the various components forming the instant invention.

Turning now descriptively to the drawings, in which similar reference characters denote similar elements throughout the several views, FIG. 1 illustrates a young girls board game 10 consisting of a container 12 for holding playing pieces 14, make-up kits 16, a game board 18 and a random numeric producing mechanism 20.

Figure 3:
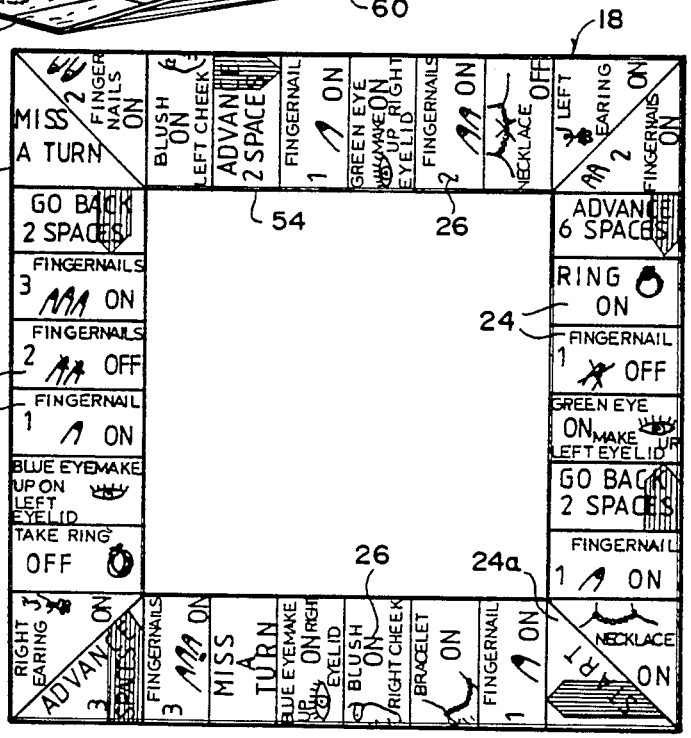
FIG. 3 is a top view of the game board showing the various spaces and instructions thereon.

Each playing piece 14 represents one young girl player, while each make-up kit 16 is designed to be used by one young girl player. The game board 18, as best seen in FIG. 3, has a continuous path around its perimeter 22 divided into consecutive spaces 24, in which one of the spaces **24*a* is a start position for the playing pieces 14, while the other spaces 24 bear instructions 26 in which most of the instructions 26 indicate what items each young girl player must put on and take off from their make-up kit 16 when their playing piece 14 lands thereon during the play of the game 10**.

The random numeric producing mechanism 20 is a die in which numeric designations on the die represent travel movements for each playing piece 14 along the continuous path of the spaces 24. When each playing piece 14 lands on one space 24 the instructions 26 will be followed.

The first young girl player to put on all of the items from her make-up kit 16 will become the winner.

Each make-up kit 16 includes a box 28 having three compartments 30, 32 and 34. A ring 36, a necklace 38, a bracelet 40 and a pair of clip earrings 42 are carried in the first compartment 30 of the box 28. A set of ten fake fingernails 44 are carried in the second compartment 32 of the box 28. A blue eye shadow 46, a green eye shadow 48, a pink blush 50 and a blush applicator 52 are carried in the third compartment 34 of the box 28. They are the items used in the play of the game 10.

Figure 2:
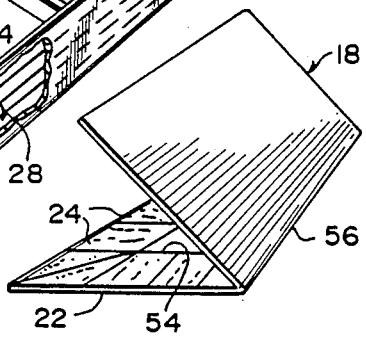
FIG. 2 is a perspective view of the game board being folded in half.
Figure 2A:
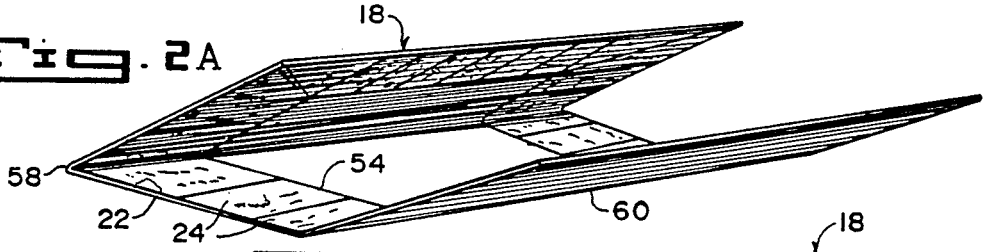
FIG. 2A is a perspective view of the game board being folded in thirds.

The game board 18 is square and the continuous path of the spaces 24 forms a further inner square 54 within the perimeter 22 of the game board 18. As shown in FIG. 2, the game board 18 includes a fold line 56 thereacross so that the game board 18 can be folded in half and placed into the container 12. As shown in FIG. 2A the game board 18 can have two fold lines 58 and 60 thereacross so that the game board 18 can be folded in thirds and placed into the container 12.

The instructions 26 in the spaces 24 starting clockwise from the start position space **24*a* on the game board 18** are as follows:

1. Start (in first corner)
2. 1 Fingernail on
3. Bracelet on
4. Blush on right cheek
5. Blue eye make-up on right eyelid
6. Miss a turn
7. 3 Fingernails on
8. Advance 3 spaces (in second corner)
9. Right earing on (in second corner)
10. Take ring off
11. Blue eye make-up on left eyelid
12. 1 Fingernail on
13. 2 Fingernails off
14. 3 Fingernails on
15. Go back 2 spaces
16. Miss a turn (in third corner)
17. 2 Fingernails on (in third corner)
18. Blush on left cheek
19. Advance 2 spaces
20. 1 Fingernail on
21. Green eye make-up on right eyelid
22. 2 Fingernails on
23. Necklace off
24. Left earring on (in fourth corner)
25. 2 Fingernails on (in fourth corner)
26. Advance 6 spaces
27. Ring on
28. 1 Fingernail off
29. Green eye make-up on left eyelid
30. Go back 2 spaces 31. 1 Fingernail on
32. Necklace on (in first corner)

The rules for playing the game 10 are as follows:

1. Each young girl player places her playing piece 14 on the start position space 24*a*.
2. To determine playing order each player rolls the die 20 one time. The player who rolls the highest number goes first and the order follows clockwise.
3. Each player rolls the die 20 and advances her playing piece 14 around the game board 18, following the instructions 26 on each space 24 the playing piece 14 lands on.
4. Winning the game 10 is accomplished by the first player to have all pieces of the jewelry 36 to 42 on, eye shadow 46/48 on both eyes (Note: It doesn't matter if one eye is blue and the other is green, as long as at least one application of eye shadow 46/48 is on each eye.), blush 50 on both cheeks and a fingernail 44 on each finger.

LIST OF REFERENCE NUMBERS

10: young girls board game
12: container
14: playing piece
16: make-up kits
18: game board
20: random numeric producing mechanism (die)
22: perimeter of 18
24: space
24*a*: start position space
26: instructions
28: box of 16
30: first compartment in 28
32: second compartment in 28
34: third compartment in 28
36: ring
38: necklace
40: bracelet
42: pair of clip earrings
44: set of ten fake fingernails
46: blue eye shadow
48: green eye shadow
50: pink blush
52: blush applicator
54: inner square on 18
56: fold line in 18
58: first fold line in 18
60: second fold line in 18.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A young girls board game comprising:
(a) a plurality of playing pieces, each representing one young girl player;
(b) a plurality of make-up kits having a plurality of items therein, said items adapted to be worn on each player's body;
(c) a game board having a continuous path around its perimeter divided into consecutive spaces, in which one of the spaces is a start position for said playing pieces while the other spaces bear instructions in which most of the instructions indicate what items from their said make-up kit each player must wear on their body and what items each player remove from their body when their playing piece lands thereon during the play of the game; and
(d) means for producing random numeric designations representing travel movements for each said playing piece along the continuous path of the spaces, so that when each said playing piece lands on one space the instructions will be followed, until the first young girl player wears all of the items from her said make-up kit will become the winner.

2. A young girls board game as recited in claim 1, further including a container for holding said playing pieces, said make-up kits, said game board and said random numeric producing means therein.

3. A young girls board game as recited in claim 2, wherein each said make-up kit includes:
(a) a box having three compartments;
(b) a ring, a necklace, a bracelet and a pair of clip earrings carried in the first compartment of said box;
(c) a set of ten fake fingernails carried in the second compartment of said box; and
(d) a blue eye shadow, a green eye shadow, a pink blush and a blush applicator carried in the third compartment of said box.

4. A young girls board game as recited in claim 3, wherein said random numeric producing means is a die.

5. A young girls board game as recited in claim 4, wherein said game board is square and the continuous path of the spaces forms a further inner square within the perimeter of said game board.

6. A young girls board game as recited in claim 5, wherein said game board further includes a fold line thereacross so that said game board can be folded in half and placed into said container.

7. A young girls board game as recited in claim 5, wherein said game board further includes two fold lines thereacross so that said game board can be folded in thirds and placed into said container.

* * * * *